US008047217B1

(12) United States Patent
Schermerhorn, Jr.

(10) Patent No.: US 8,047,217 B1
(45) Date of Patent: Nov. 1, 2011

(54) ANCHORABLE UMBRELLA APPARATUS

(76) Inventor: William R. Schermerhorn, Jr., Colfax, NC (US)

( * ) Notice: Subject to any disclaimer, the term of this patent is extended or adjusted under 35 U.S.C. 154(b) by 0 days.

(21) Appl. No.: 12/917,290

(22) Filed: Nov. 1, 2010

(51) Int. Cl.
*E04H 15/62* (2006.01)

(52) U.S. Cl. ..... 135/118; 135/16; 248/519; 248/910

(58) Field of Classification Search ..... 135/16, 135/118; 248/910, 519, 523, 529
See application file for complete search history.

(56) References Cited

U.S. PATENT DOCUMENTS 4,296,693 A 10/1981 Archer
4,924,893 A 5/1990 Furey
5,169,111 A * 12/1992 Dunaj ..... 248/523
5,452,877 A 9/1995 Riffle et al.
6,164,613 A * 12/2000 Williams ..... 248/533
6,446,649 B1 9/2002 Bigford
7,168,437 B2 * 1/2007 Bigford ..... 135/16
2002/0036008 A1 * 3/2002 Hickam et al. ..... 135/98
* cited by examiner

*Primary Examiner* — Noah Chandler Hawk
(74) *Attorney, Agent, or Firm* — Crossley Patent Law; Mark A. Crossley

(57) ABSTRACT

The anchorable umbrella apparatus has a pole having a first section slideably and removably fitted within the second section, a receiver with cam lock disposed atop the first section, an object fitted atop the first section, a pointed tip disposed downwardly on the second section, a visual guide disposed downwardly on the second section, a collar slideably fitted around the pole second section, a plurality of equally spaced apart butterfly bolts radialy and threadably inserted through the collar, a Y end disposed outwardly on each butterfly bolt, a tarp comprising a reinforcement disposed centrally within the tarp, an opening disposed within the reinforcement, and a plurality of spaced apart grommets disposed outwardly within the tarp, each grommet selectively engaged with one of each of the Y ends of one of each of the butterfly bolts.

9 Claims, 5 Drawing Sheets

ANCHORABLE UMBRELLA APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

The need to anchor umbrellas and other such devices against unwanted movement has long been understood as is evidenced by previously presented devices for same. Some devices require carrying some form of weight to add low level mass to the umbrella in order to resist movement caused by wind for example. Other devices require anchors much like those of a tent, such as stakes, screws and other such devices, or even anchors with guy wires. Other like devices require filling and emptying of a vessel. Such vessels are inconvenient, especially in emptying, and also limit what may be used to fill the vessel. Some anchoring devices are added to an existing umbrella assembly in some way, yet device additions inherently limit superior design and function. The present apparatus provides a complete anchorable umbrella and allows easy fill and emptying without a defined vessel, and needs no transportable weight, and thereby provides a truly lightweight and portable apparatus.

FIELD OF THE INVENTION

The anchorable umbrella apparatus relates to umbrellas, umbrella stands, and related stanchions with supports and more especially to a complete anchorable umbrella assembly that negates transporting weights and filling of a defined vessel.

SUMMARY OF THE INVENTION

The general purpose of the anchorable umbrella apparatus, described subsequently in greater detail, is to provide an anchorable umbrella apparatus which has many novel features that result in an improved anchorable umbrella apparatus which is not anticipated, rendered obvious, suggested, or even implied by prior art, either alone or in combination thereof.

To attain this, the anchorable umbrella apparatus provides for use as more than just an umbrella. The apparatus may be topped with the folding umbrella. The first section may also be topped with a signpost, banner, or other useful feature or object. Of great importance is that the apparatus need not carry any additional weight, such water or sand as are often used, in order to be strongly anchored to surface. The apparatus importantly also need not be staked like tents and the like, which can be difficult if not impossible in rocky ground, for example. Also, sandy surface materials need extremely long stakes in order to attempt to accomplish what the apparatus design does without stakes.

The apparatus offers further advantages by being easily filled and emptied of surrounding materials, such as rock, sand, and dirt, for example. The apparatus, therefore, provides very important lightweight portability and installation advantages as opposed to other such devices that must either have to have a vessel filled with water or sand or the like or be staked, for example. Carrying or supporting, filling, and especially emptying any defined vessel is not only inconvenient, but cumbersome and much more difficult than is filling the tarp of the present apparatus.

The present apparatus requires no tools, not even a screwdriver, no ties or tying and is a complete apparatus, except for the chosen tarp fill. Further, the present apparatus supports whatever device is affixed to the first section unidirectionally, such that no wind direction need be considered. The cam lock used to selectively locate the first section within the second section of the pole provides positive and rapid performance. The guide within the lower portion of the second section importantly prevents a user from having to guess how deeply to embed the pole and where to properly locate the collar for best selected fill performance, as well as aiding in providing a range of best collar location performance. Another advantage of the guide is that the selectively tightened butterfly bolts also perform as grommet anchors for the tarp.

The apparatus may or may not have delineated divisions between the inner isosceles triangle and the outer triangles. The triangular division delineations may also only be used for explanation purposes.

Additionally, the delineated divisions may assist users in installation by helping to define fill capacities of various weighting materials. The apparatus, while in illustration features a hexagonal shape, may be produced as a triangle. The apparatus tarp may be supplied with any number of spaced apart grommets. The hexagonal illustration with three grommets is an ideal embodiment but the apparatus is in no way limited to a hexagonal shape, nor to a triangular shape. The apparatus collar with spaced apart butterfly bolts is not limited to three bolts nor is the tarp limited to three grommets.

Thus has been broadly outlined the more important features of the improved anchorable umbrella apparatus so that the detailed description thereof that follows may be better understood and in order that the present contribution to the art may be better appreciated.

An object of the anchorable umbrella apparatus is to provide an easily anchored apparatus.

Another object of the anchorable umbrella apparatus is to provide extreme portability.

A further object of the anchorable umbrella apparatus is to negate additional anchoring devices.

An added object of the anchorable umbrella apparatus is to negate the use of transported weight.

Still another object of the anchorable umbrella apparatus is to negate the use of a defined vessel.

Yet another object of the anchorable umbrella apparatus is to provide superior anchoring in windy conditions.

These together with additional objects, features and advantages of the improved anchorable umbrella apparatus will be readily apparent to those of ordinary skill in the art upon reading the following detailed description of presently preferred, but nonetheless illustrative, embodiments of the improved anchorable umbrella apparatus when taken in conjunction with the accompanying drawings.

DETAILED DESCRIPTION OF THE DRAWINGS

With reference now to the drawings, and in particular FIGS. 1 through 5 thereof, the principles and concepts of the anchorable umbrella apparatus generally designated by the reference number 10 will be described.

Figure 5:
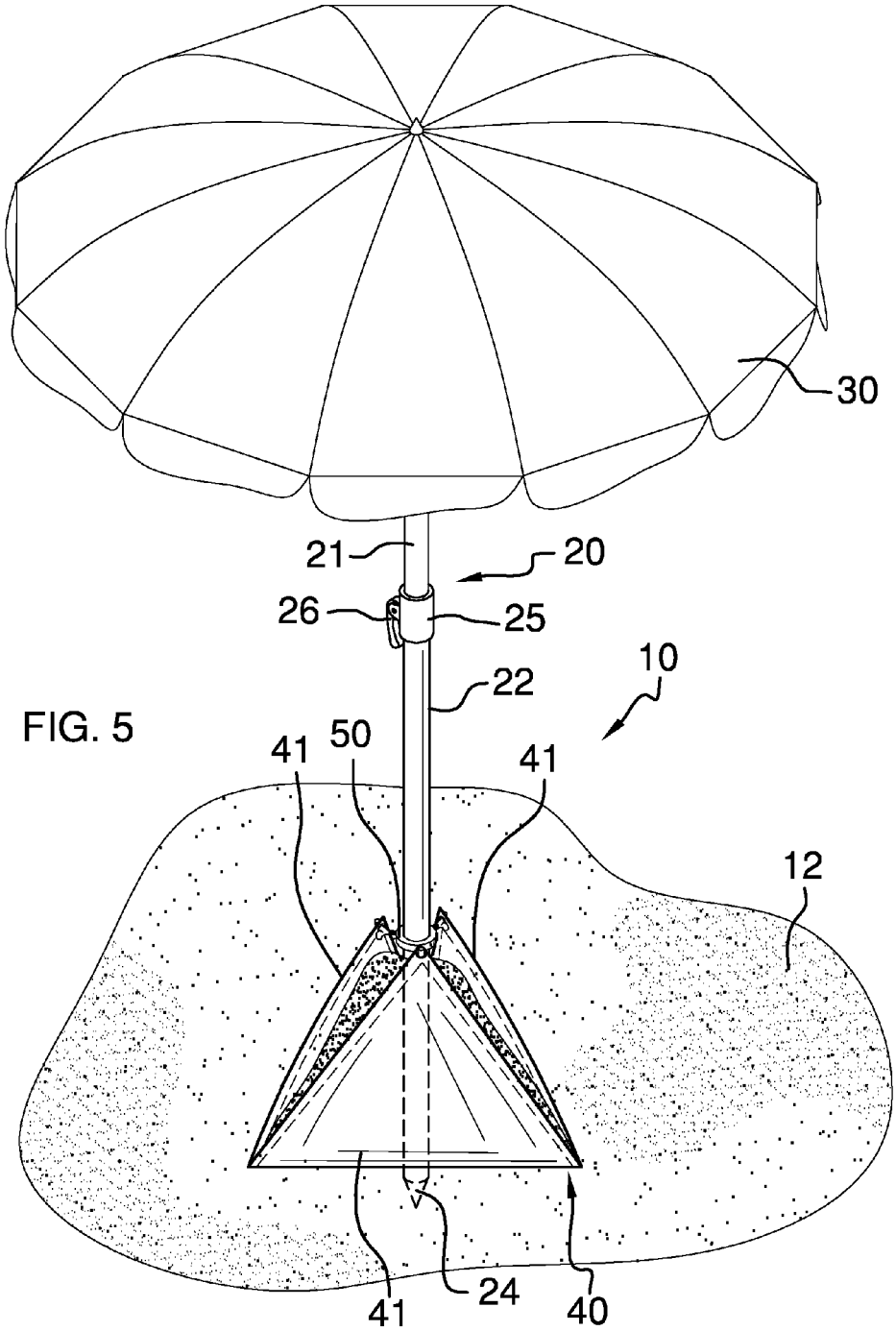
FIG. 5 is a perspective of the apparatus fully in use.

Referring to FIG. 5, the apparatus 10 partially comprises the pole 20 having a first section 21 slideably and removably fitted within the second section 22. The receiver 25 is disposed atop the second section 22. The first section 21 is fitted within the receiver 25, and the cam lock 26 disposed on the receiver 25 selectively tightens the first section 21 at a desired height within the second section 22. The folding umbrella 30 is fitted atop the first section 21.

Figure 3:
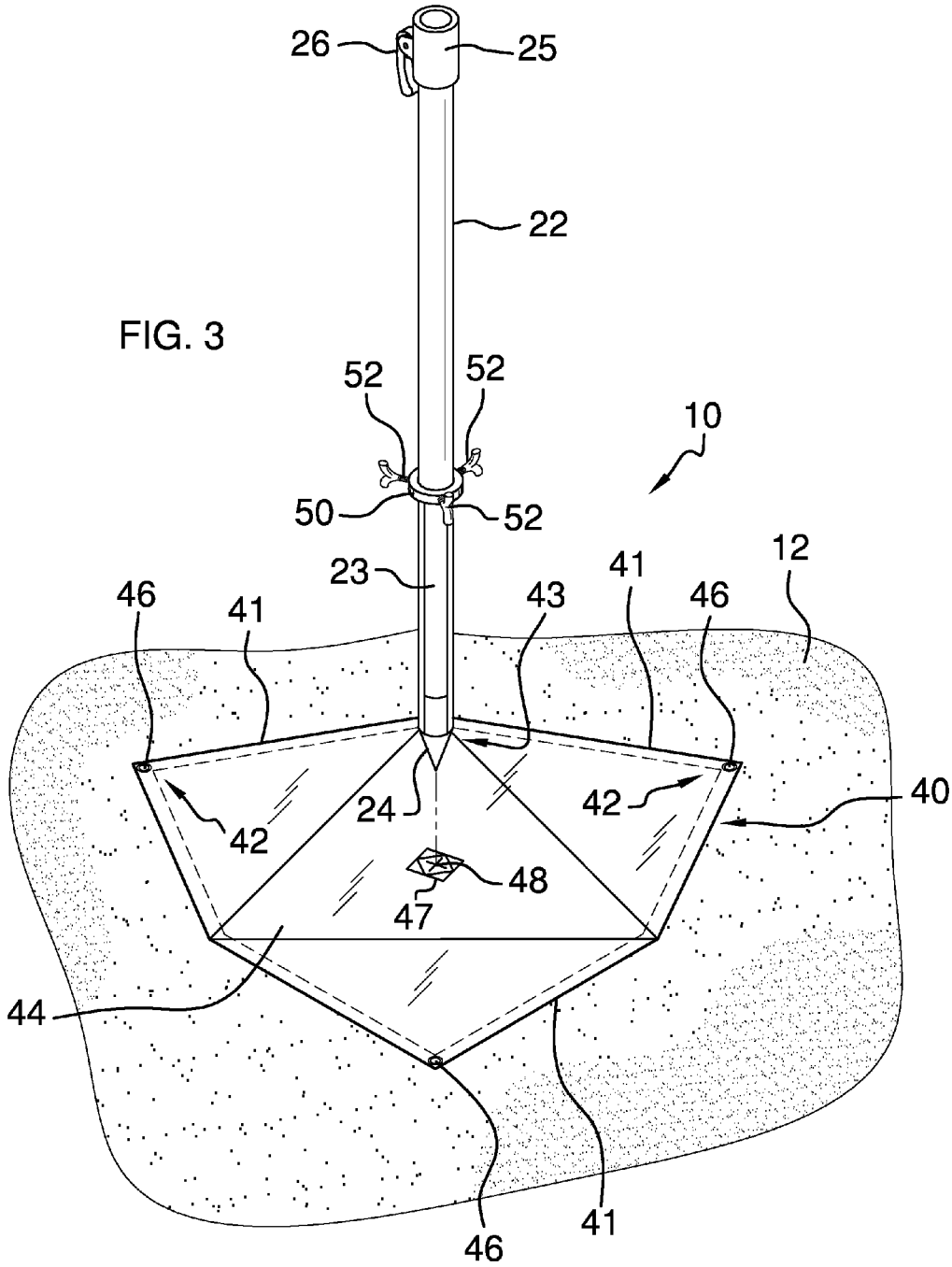
FIG. 3 is a perspective view of the tarp located on an existing surface, with section pole section in preparation of fit within the tarp opening.

Referring to FIG. 3, the pointed tip 24 is disposed downwardly on the second section 22. The visual guide 23 is disposed downwardly on the second section 22. The collar 50 is slideably fitted around the pole 20 second section 22.

Figure 2:
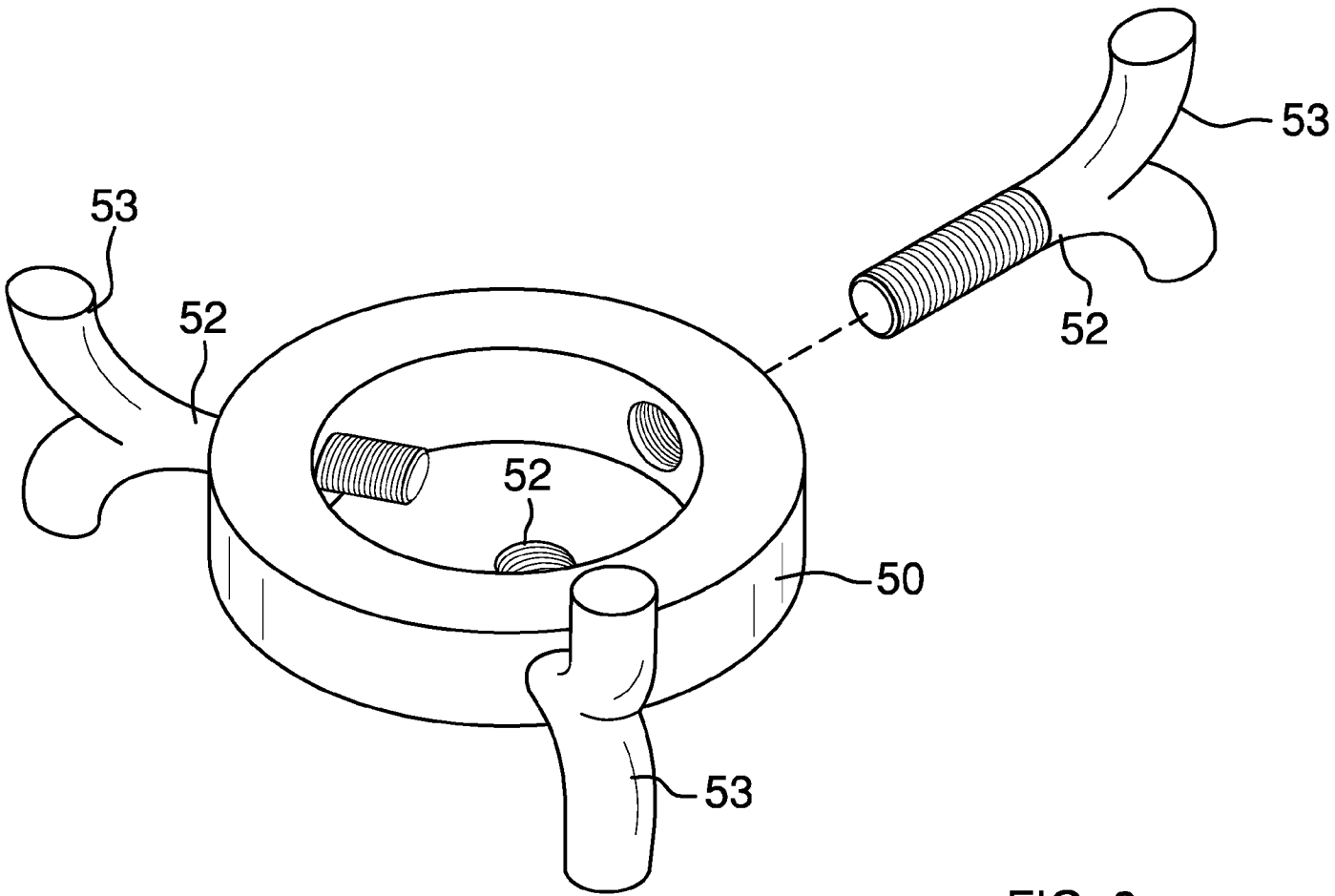
FIG. 2 is a perspective view of the collar with butterfly bolts.

Referring to FIG. 2, the trio of equally spaced apart butterfly bolts 52 is radialy and threadably inserted through the collar 50. A Y end 53 is disposed outwardly on each butterfly bolt 52.

Figure 1:
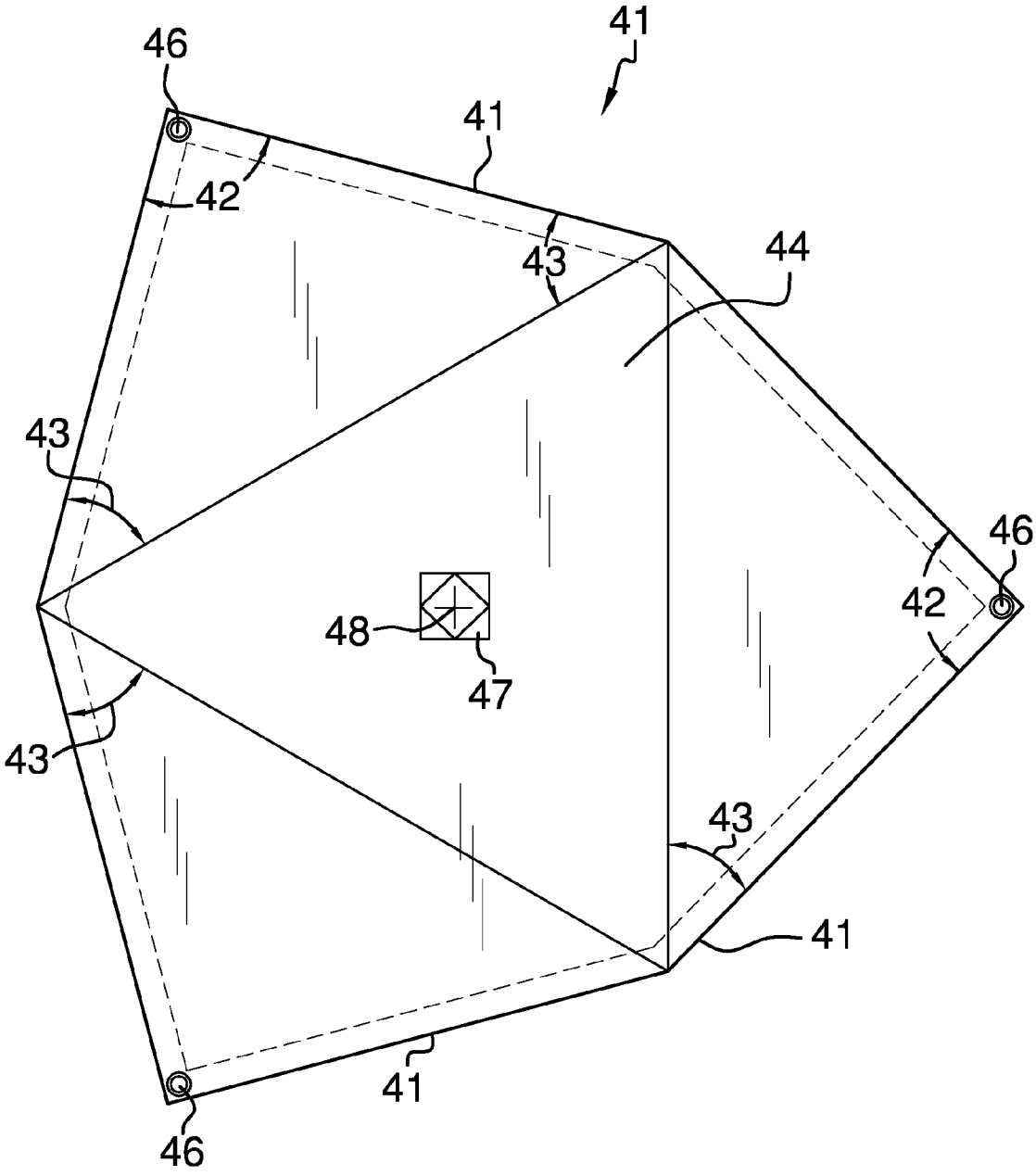
FIG. 1 is a top plan view of the tarp.

Referring to FIG. 1, the hexagonal tarp 40 partially comprises the isosceles inner triangle 44. The reinforcement 47 is disposed centrally within the isosceles inner triangle 44. The opening 48 is disposed within the reinforcement 47. An outer triangle 42 abuts each side of the isosceles inner triangle 44. Each outer triangle 41 further comprises an outer angle 42 of about 90 degrees and a pair of spaced apart companion angles 43 of about 45 degrees each. A grommet 46 is disposed within the outer angle 42 of each outer triangle 41.

Figure 4:
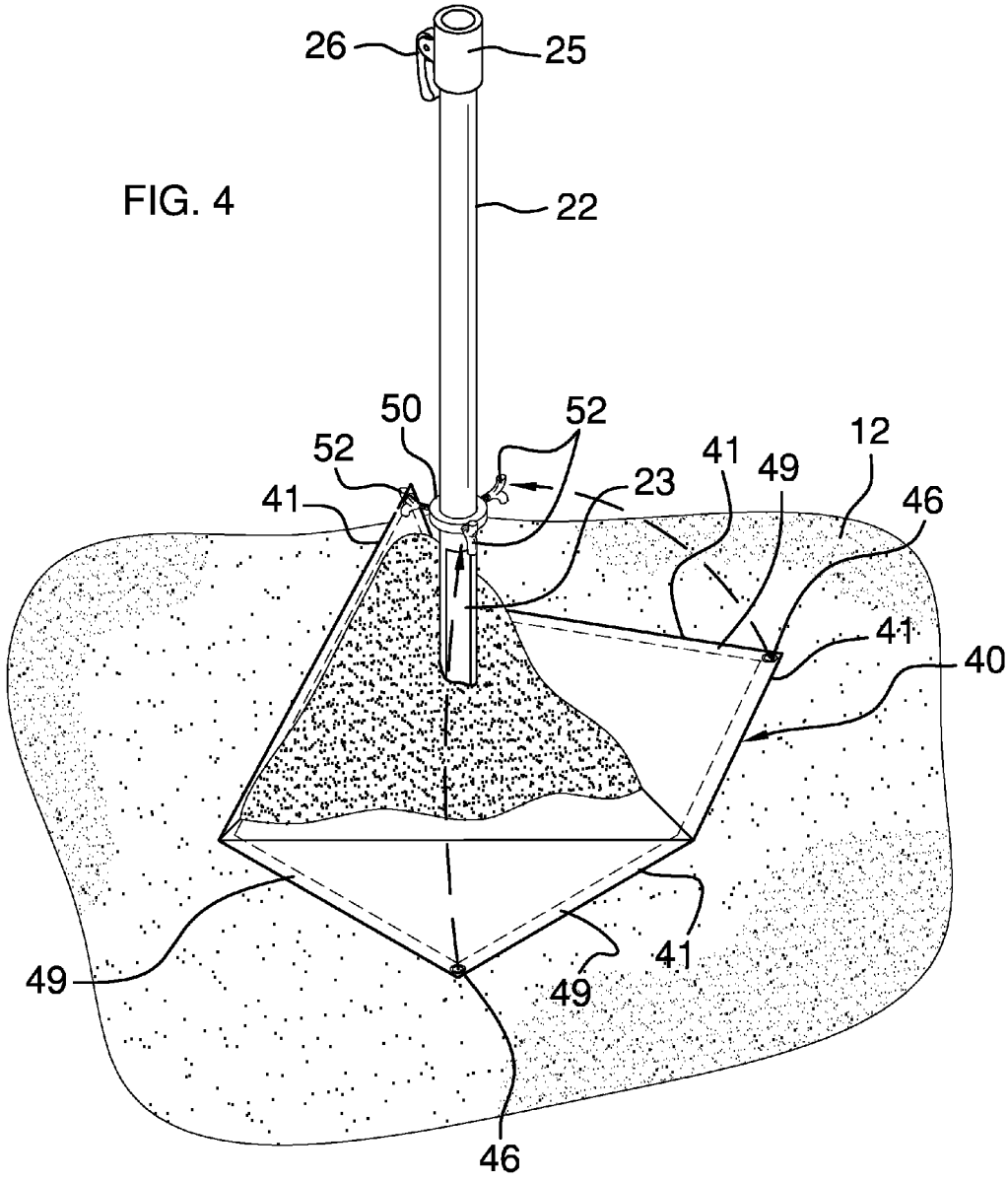
FIG. 4 is a perspective view of the tarp fitted to an existing surface, with a portion of the surface within the tarp and with the pole second section fitted within the tarp opening.

Referring to FIG. 4 and FIG. 5, each grommet 46 is selectively engaged with one of each of the Y ends 53 of one of each of the butterfly bolts 52. The overlapping border 49 is disposed totally around the tarp 40 and ensures strength and insures against failure. In use, the tarp 40 is place upon an existing surface 12, such as beach sand for example. The pole 20 second section 22 is inserted through the opening 48 with the pointed tip embedded into the surface 12. The second section 22 is embedded such that the bottom of the guide 23 is at about surface 12 level. The beach sand is used to fill the inner triangle 44 and also into the outer triangles 41. Each outer triangle 41 is lifted such that one of each grommet 46 can be hooked on one of each of the butterfly bolt 52 Y ends 53. The apparatus 10 is thereby inserted into the surface 12 and weighted upon the surface 12 by the surface 12 itself. Removal is reversal is installation.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the anchorable umbrella apparatus may be used.

What is claimed is:

1. An anchorable umbrella apparatus comprising, in combination:

a pole having a first section slideably and removably fitted within a second section;

a receiver disposed atop the second section, the first section fitted within the receiver;

a cam lock disposed on the receiver;

an object fitted atop the first section;

a pointed tip disposed downwardly on the second section;

a visual guide disposed downwardly on the second section;

a collar slideably fitted around the pole second section;

a plurality of equally spaced apart butterfly bolts radialy and threadably inserted through the collar;

a Y end disposed outwardly on each butterfly bolt;

a tarp, the tarp further comprising:

a reinforcement disposed centrally within the tarp;

an opening disposed within the reinforcement;

a plurality of spaced apart grommets disposed outwardly within the tarp, each grommet selectively engaged with one of each of the Y ends of one of each of the butterfly bolts.

2. The apparatus according to claim 1 wherein the tarp further comprises an overlapping border disposed totally and outwardly around the tarp.

3. The apparatus according to claim 1 wherein the object fitted atop the first section further comprises an umbrella.

4. The apparatus according to claim 2 wherein the object fitted atop the first section further comprises an umbrella.

5. An anchorable umbrella apparatus comprising, in combination:

a pole having a first section slideably and removably fitted within a second section;

a receiver disposed atop the second section, the first section fitted within the receiver;

a cam lock disposed on the receiver;

an object fitted atop the first section;

a pointed tip disposed downwardly on the second section;

a visual guide disposed downwardly on the second section;

a collar slideably fitted around the pole second section;

a trio of equally spaced apart butterfly bolts radialy and threadably inserted through the collar;

a Y end disposed outwardly on each butterfly bolt;

a triangular tarp, the tarp further comprising:

a reinforcement disposed centrally within the triangle;

an opening disposed within the reinforcement;

a grommet disposed within an each outer angle of the triangle, each grommet selectively engaged with one of each of the Y ends of one of each of the butterfly bolts.

6. The apparatus according to claim 5 wherein the tarp further comprises an overlapping border disposed totally and outwardly around the tarp.

7. The apparatus according to claim 5 wherein the object fitted atop the first section further comprises an umbrella.

8. The apparatus according to claim 6 wherein the object fitted atop the first section further comprises an umbrella.

9. An anchorable umbrella apparatus comprising, in combination:

a pole having a first section slideably and removably fitted within a second section;

a receiver disposed atop the second section, the first section fitted within the receiver;

a cam lock disposed on the receiver;

a folding umbrella fitted atop the first section;

a pointed tip disposed downwardly on the second section;

a visual guide disposed downwardly on the second section;

a collar slideably fitted around the pole second section;

a trio of equally spaced apart butterfly bolts radialy and threadably inserted through the collar;

a Y end disposed outwardly on each butterfly bolt;

a hexagonal tarp, the tarp further comprising:

an isosceles inner triangle;

a reinforcement disposed centrally within the isosceles inner triangle;

an opening disposed within the reinforcement;

an outer triangle abutting an each side of the isosceles inner triangle, each outer triangle further comprising:

an outer angle of about 90 degrees;

a pair of spaced apart companion angles of about 45 degrees each;

a grommet disposed within the outer angle of each outer triangle, each grommet selectively engaged with one of each of the Y ends of one of each of the butterfly bolts;

an overlapping border disposed totally around the tarp.

* * * * *